US005778912A

United States Patent [19]

Lee

[11] Patent Number: 5,778,912

[45] Date of Patent: Jul. 14, 1998

[54] PANEL WASHING DEVICE FOR CATHODE RAY TUBE

[75] Inventor: Kil-won Lee, Suwon, Rep. of Korea

[73] Assignee: Samsung Display Devices Co., Ltd., Kyungki-do, Rep. of Korea

[21] Appl. No.: 773,973

[22] Filed: Dec. 26, 1996

[30] Foreign Application Priority Data

Jul. 30, 1996 [KR] Rep. of Korea ..... 1996-31532

[51] Int. Cl.[6] ..... B08B 3/04

[52] U.S. Cl. ..... 134/104.2; 134/117

[58] Field of Search ..... 134/117, 104.2, 134/182, 183, 135, 164, 201, 23, 22.1, 22.11, 25.4; 445/59

[56] References Cited

U.S. PATENT DOCUMENTS

| | | | |
|---|---|---|---|
| 1,387,776 | 8/1921 | Henning | 134/135 |
| 2,763,276 | 9/1956 | Irwin | 134/137 |
| 3,326,224 | 6/1967 | Gartner | 134/152 |
| 3,746,020 | 7/1973 | Pekosh | 134/166 R |
| 3,873,365 | 3/1975 | Dapolito et al. | 134/152 |
| 4,974,616 | 12/1990 | Lee | 134/39 |
| 5,127,578 | 7/1992 | Choi et al. | 134/168 R |
| 5,135,420 | 8/1992 | Sumi et al. | 134/18 |
| 5,159,946 | 11/1992 | Seiichiro | 134/182 |
| 5,344,395 | 9/1994 | Yanai et al. | 134/22.1 |
| 5,469,875 | 11/1995 | Rodarmer et al. | 134/117 |
| 5,485,861 | 1/1996 | Hiratsuka et al. | 134/182 |

FOREIGN PATENT DOCUMENTS

| | | | |
|---|---|---|---|
| 1081695 | 5/1960 | Germany | 134/117 |
| 1266577 | 10/1986 | U.S.S.R. | 134/117 |

*Primary Examiner*—Amy B. Vanatta
*Attorney, Agent, or Firm*—Leydig, Voit & Mayer, Ltd.

[57] ABSTRACT

A washing device for a cathode ray tube is provided. The panel washing device includes a carrier for transferring the panel, a tank installed below the panel, a meshed plate member installed inside the tank, an elastic member, installed between the inner bottom surface of the tank and the meshed plate member, for elastically biasing the meshed plate member in an upward direction, and a lifter for lifting the tank. Accordingly, inner and outer surfaces and the sealing end of a panel skirt can be effectively washed.

10 Claims, 3 Drawing Sheets

PANEL WASHING DEVICE FOR CATHODE RAY TUBE

BACKGROUND OF THE INVENTION

The present invention relates to a panel washing device for a cathode ray tube (CRT), and more particularly, to a panel washing device for a cathode ray tube for washing foreign substances attached to a skirt of the panel.

Generally, a cathode ray tube includes of a panel 10 having a fluorescent film formed therein, a shadow mask frame assembly 12 installed at a predetermined distance from the panel 10, a funnel 14 sealed and coupled to the panel 10, an electron gun 16 installed in the neck portion 14*a* of the funnel 14, and a deflection yoke 18 installed around the conical portion 14*b* of the funnel 14.

Among manufacturing processes of the panel, there is a process for removing foreign substances attached to inner and outer surfaces and the end of the panel skirt to be sealed, prior to forming the fluorescent and reflection films inside the panel and coupling the panel to the funnel. Since lacquer coated on the internal surface and the sealing end of the skirt in the process of forming the fluorescent film of the panel serves as a foreign substance in forming the reflection film or coupling the panel to the funnel, the panel should be completely washed away.

FIG. 2 shows an example of a conventional washing device for washing the skirt of the panel.

The panel washing device comprises a carrier 21 for transferring and rotating the panel 10 in a state in which each side of the panel 10 is supported and the skirt 10*a* of the panel faces down, a supporting member 22 installed below the carrier 21, a fabric 23 soaked in acetone on the surface of the supporting member 22, a bracket 24 for supporting the supporting member 22, and a cylinder 25 for lifting the supporting member 22.

In the conventional panel washing device having the structure as described above, when the panel 10 is transferred by the carrier 21 to an upper portion of the supporting member 22, the cylinder 25 lifts the supporting member 22, so that the sealing end of the skirt 10*a* contact the fabric 23 attached to the supporting member 22. In this state, the panel 10 is rotated by the rotation of the carrier 21 to cause a frictional contact between the fabric 23 and the sealing end of the skirt 10*a*, thereby cleaning the panel.

However, the conventional panel washing device has the following problems. First, since the fabric contacts the sealing end of the skirt, the inner and outer surfaces of the skirt cannot be washed. Therefore, the finished panel is inferior due to the presence of foreign substances in the process of forming the reflection film. Second, a beveled portion formed on the sealing end of the skirt cannot be completely washed, thus causing inferior coupling due to presence of foreign substances in the beveled portion. Third, the washing solution of the fabric splashes inside the panel, thus contaminating the fluorescent film formed inside the panel.

SUMMARY OF THE INVENTION

It is an object of the present invention to provide a panel washing device which can effectively wash inner and outer surfaces and the sealing end of a skirt of a panel.

To achieve the above object, there is provided a panel washing device, comprising a carrier for transferring a panel, a tank installed underneath the panel transferred by the carrier to receive a skirt of the panel and containing solution for washing the skirt of the panel, a meshed plate member installed inside the tank, an elastic member, installed between the upper bottom surface of the tank and the meshed plate member, for elastically biasing the meshed plate member in an upward direction, and means for lifting the tank to the panel.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
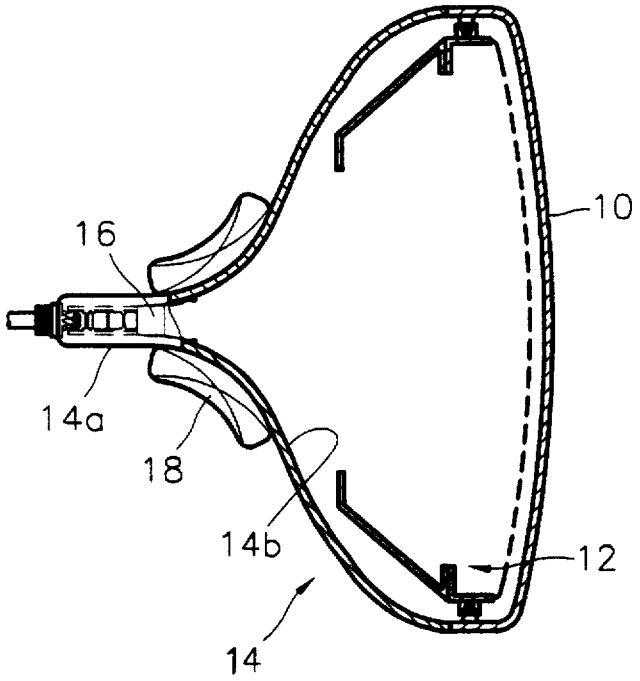
FIG. 1 is a sectional view of a general cathode ray tube.
Figure 2:
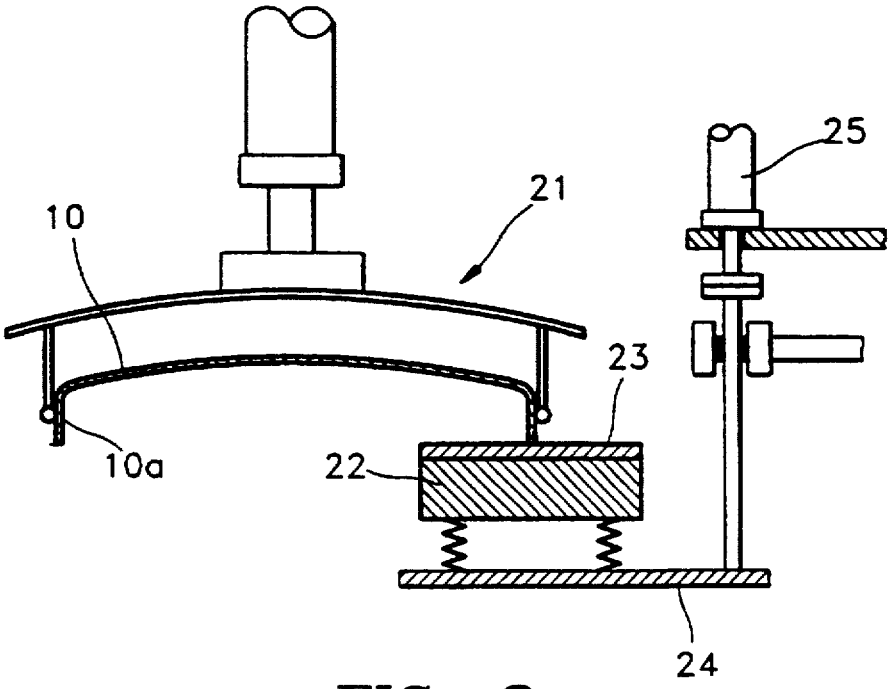
FIG. 2 (PRIOR ART)
FIG. 2 is a side view showing a conventional panel washing device.
Figure 3:
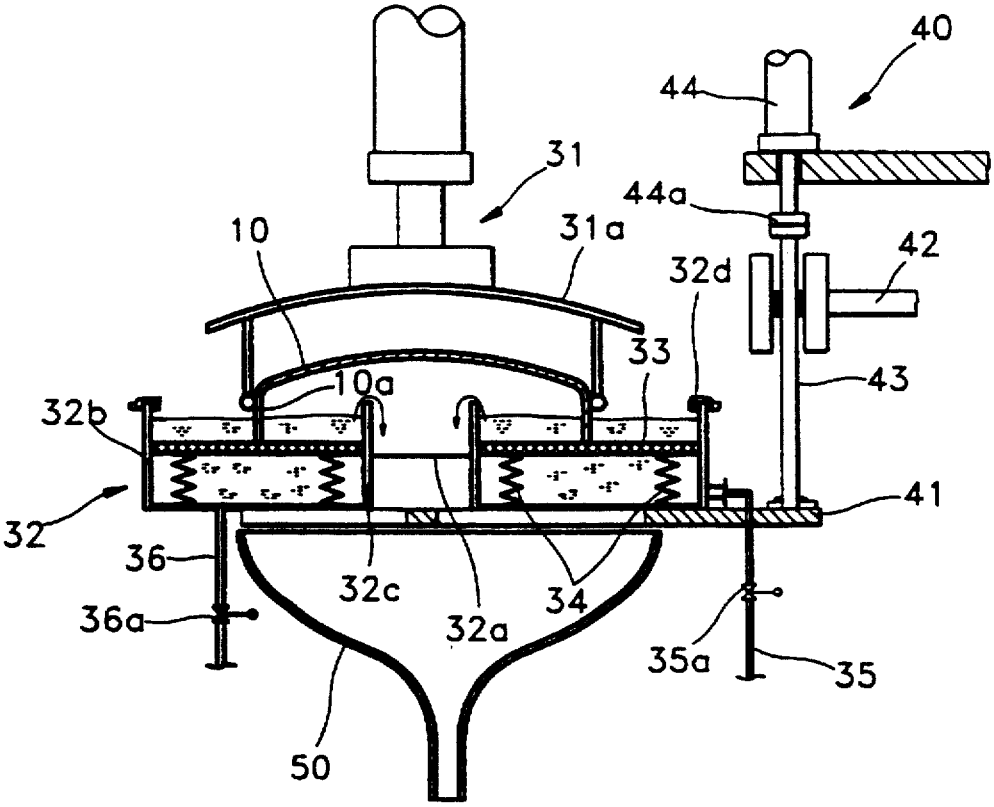
FIG. 3 is a side sectional view showing a panel washing device according to the present invention.
Figure 4:
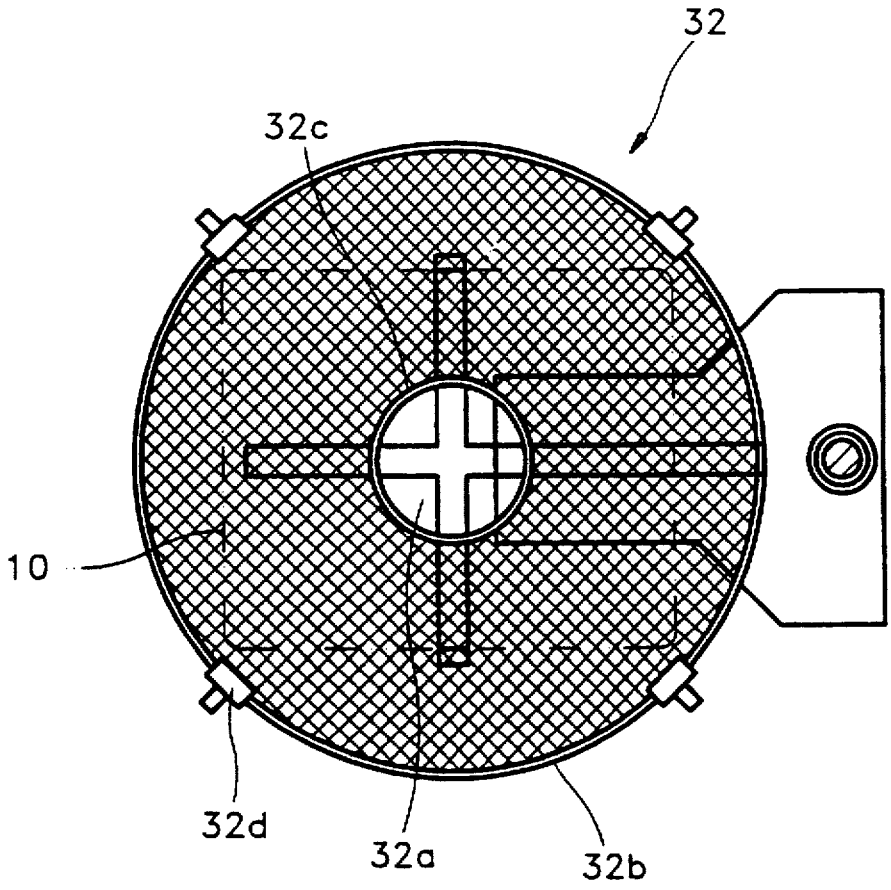
FIG. 4 is a plan view of a tank shown in FIG. 3.

Referring to FIGS. 3 and 4, a panel washing device according a preferred embodiment of the present invention includes a carrier 31 having a head portion 31*a* for supporting each side of the panel 10 so that the sealing end of the skirt 10*a* of the panel 10 faces in a downward direction and a tank 32 installed below the panel 10 supported by the head portion 31*a*. In the middle portion of the tank 32, a hollow portion 32*a* for draining air and washing solution is formed by an inner wall 32*c* of the tank 32. Here, an outer wall 32*b* of the tank 32 is formed to be higher than the inner wall 32*c*.

Inside the tank 32, a meshed plate member 33 is installed and elastically biased to an upward direction by an elastic member 34 installed on the bottom of the tank 32. The meshed plate member 33 supported by the elastic member 34 is limited by a stopper 32*d* installed inside the outer wall 32*b* of the tank 32 and positioned above the washing solution by a predetermined distance, so as to keep the plate member above the surface of the washing solution. Here, acetone is used as the washing solution. A supply tube 35 for supplying acetone is connected to the outer wall 32*b* of the tank 32. A drain tube 36 for draining the washing solution is installed at the bottom of the tank 32. Valves 35*a* and 36*a* for controlling the flow rate of the washing solution are respectively installed in the supply tube 35 and the drain tube 36.

A lifter 40 for lifting the tank 32 to the panel 10 supported by the carrier 31 is installed below the tank 32. The lifter 40 includes a bracket 41, fixed to the lower surface of the tank 32 and extending past one side of the tank, a guide rod 43 having one end connected to the bracket 41 and slidably installed through a frame 42, and a cylinder 44 having a rod 44*a* connected to the other end of the guide rod 43. Reference numeral 50 denotes a hopper for receiving overflow washing solution through the hollow portion 32*a*.

The panel washing device according to the present invention having the structure as described above operates as follows.

When the panel 10 supported by the head portion 31*a* of the carrier 31 is placed above the tank 32, as shown in FIG. 3, the cylinder 44 of the lifter 40 lifts the guide rod 43, thereby lifting the tank 32 to a predetermined height. Accordingly, the sealing end of the skirt 10*a* contacts the upper surface of the meshed plate member 33 and the meshed plate member 33 is pressed down, resisting the elastic force of the elastic member 34, thus immersing the skirt 10*a* of the panel 10 in the washing solution.

Therefore, foreign substances such as lacquer attached to the inner and outer surfaces and the sealing end of the skirt 10*a* are washed by being dissolved in acetone. In washing the panel 10, the tank 32 preferably rises so as to easily dissolve foreign substances, such as lacquer, in the acetone. When necessary, it is possible to rotate the panel 10 by rotating the carrier 31. It is also preferable to supply the washing solution in a constant quantity through the supply tube 35 to maintain an appropriate concentration of acetone during the washing process. At this time, the overflow washing solution from the tank 32 is drained to the hopper 50 through the hollow portion 32*a* located in the middle portion.

When the inner and outer surfaces and the sealing end of the skirt 10*a* are completely washed as mentioned above, the end portions of the panel 10 comes out from the washing solution by lowering the tank 32 by operating the cylinder 44. At this time, the meshed plate member 33, elastically biased by the elastic member 34, rises as the tank 32 lowers and is caught by the stopper 32*d*.

The panel washing device of the present invention operated in the manner described above has the following effects.

First, the inner and outer surfaces and the sealing end of the panel skirt can be washed. Second, foreign substances attached to the beveled portion of the sealing end can be removed. Third, it is possible to prevent the panel from being excessively immersed in the washing solution since the meshed plate member which contacts the sealing end inside of the tank is installed to be elastically biased in an upward direction and splashing of the washing solution on the panel is prevented since the location of the meshed plate member above the washing solution is limited by the stopper. Fourth, since the foreign substances, i.e., remnant of lacquer, are completely dissolved by the washing solution, it is possible to prevent the foreign substances from streaming down the side of the panel. Fifth, it is possible to prevent vacuum pressure from leaking through the seal of the coupling due to an inferior washing process.

The panel washing device of the present invention is described with respect to an embodiment shown in the drawings. However, the present invention is not restricted to the above embodiment, and it is clearly understood that many variations are possible within the scope and spirit of the present invention by one skilled in the art.

What is claimed is:

1. A panel washing device for a cathode ray tube comprising:

a carrier for transferring a panel;

a tank installed underneath the panel transferred by said carrier to receive a skirt of said panel and containing solution for washing the skirt of said panel and including an outer wall and an inner wall which is lower than the outer wall and which forms a hollow portion in the middle of said tank;

a meshed plate member installed inside said tank;

an elastic member, installed between the upper bottom surface of said tank and the meshed plate member, for elastically biasing the meshed plate member in an upward direction;

means for lifting said tank to said panel; and a hopper disposed beneath said tank for receiving overflow washing solution which is drained through said hollow portion.

2. A panel washing device for a cathode ray tube as claimed in claim 1, wherein said washing solution is acetone.

3. A panel washing device for a cathode ray tube as claimed in claim 1, wherein a stopper for limiting the height of said meshed plate member is installed in said tank so that said meshed plate member remains above the surface of said washing solution in said tank.

4. A panel washing device for a cathode ray tube as claimed in claim 1, wherein said lifting means comprises:

a bracket coupled to the bottom of said tank;

a guide rod having one end portion connected to said bracket; and a cylinder having a rod connected to the other end of said guide rod.

5. A panel washing device for a cathode ray tube as claimed in claim 1, further comprising:

a washing solution supply tube connected to the side of said tank; and a valve, installed in said supply tube, for controlling the supply of washing solution into said tank.

6. A panel washing device for a cathode ray tube as claimed in claim 1, wherein said meshed plate member includes an upper surface with a region for directly contacting the skirt of said panel.

7. A panel washing device for a cathode ray tube as claimed in claim 6, wherein said region is flat.

8. A panel washing device for a cathode ray tube as claimed in claim 1, wherein said elastic member is disposed inside said tank.

9. A panel washing device for a cathode ray tube as claimed in claim 8, wherein said elastic member is completely immersed in the washing solution.

10. A panel washing device for a cathode ray tube as claimed in claim 1, wherein the hopper has a funnel-shaped cross section.

* * * * *